US009693594B1

(12) United States Patent
Castro et al.

(10) Patent No.: US 9,693,594 B1
(45) Date of Patent: Jul. 4, 2017

(54) PROTECTIVE HEADGEAR

(71) Applicant: Harvest Moon Inventions, LLC, Tempe, AZ (US)

(72) Inventors: Mynor J. Castro, Chandler, AZ (US); Caroline Vanlngen-Dunn, Tempe, AZ (US); Ira Harold Dorfman, Bethesda, MD (US)

(73) Assignee: Harvest Moon Inventions, LLC, Tempe, AZ (US)

( * ) Notice: Subject to any disclaimer, the term of this patent is extended or adjusted under 35 U.S.C. 154(b) by 66 days.

(21) Appl. No.: 14/624,078

(22) Filed: Feb. 17, 2015

Related U.S. Application Data

(60) Provisional application No. 61/941,327, filed on Feb. 18, 2014.

(51) Int. Cl.

| | |
|---|---|
| ***A63B 71/10*** | (2006.01) |
| ***A42B 3/12*** | (2006.01) |
| ***A42B 3/28*** | (2006.01) |
| ***A42B 1/22*** | (2006.01) |

(52) U.S. Cl.
CPC ..... *A42B 3/125* (2013.01); *A42B 1/22* (2013.01); *A42B 3/283* (2013.01); *A63B 71/10* (2013.01)

(58) Field of Classification Search
CPC .. A42B 3/28; A42B 3/06; A42B 3/125; A63B 71/10
USPC ..... 2/410, 414, 415
See application file for complete search history.

(56) References Cited

U.S. PATENT DOCUMENTS

| | | | | |
|---|---|---|---|---|
| 5,561,866 | A * | 10/1996 | Ross | A42B 3/124 2/410 |
| 5,661,854 | A | 9/1997 | March et al. | |
| 6,425,141 | B1 | 7/2002 | Ewing et al. | |
| 7,341,776 | B1 * | 3/2008 | Milliren | A41D 13/05 2/411 |
| 7,937,778 | B1 * | 5/2011 | Norton | A42B 1/08 2/175.4 |
| 8,220,072 | B2 | 7/2012 | Dodd | |
| 8,627,512 | B2 | 1/2014 | Dodd | |
| 8,661,564 | B2 | 3/2014 | Dodd | |
| 8,961,733 | B2 | 2/2015 | Dodd | |
| 9,254,433 | B2 | 2/2016 | Dodd | |
| 2003/0221245 | A1 * | 12/2003 | Lee | A42B 3/063 2/412 |
| 2009/0031481 | A1 | 2/2009 | Dennis et al. | |
| 2011/0203024 | A1 * | 8/2011 | Morgan | F41H 1/04 2/2.5 |
| 2011/0307997 | A1 * | 12/2011 | Blair | A42B 1/08 2/414 |

(Continued)

OTHER PUBLICATIONS

ESPN The Magazine, "Ding Training," p. 27, Mar. 21, 2011.

(Continued)

*Primary Examiner* — Katherine Moran
(74) *Attorney, Agent, or Firm* — Perkins Coie LLP

(57) ABSTRACT

A protective device for a head of an individual person. The protective device forms a cap that includes a flexible headpiece and a segmented outer protective shell disposed about the flexible headpiece for distributing an impact load. The device covers and protects the front, top, sides and back of the head from impact injuries and rebound effects of high speed objects as seen for example, a baseball or softball moving at a speed of up to about 125 mph.

25 Claims, 6 Drawing Sheets

(56) References Cited

U.S. PATENT DOCUMENTS

| | | | | |
|---|---|---|---|---|
| 2012/0047635 | A1* | 3/2012 | Finiel | A42B 3/125 2/414 |
| 2012/0079647 | A1 | 4/2012 | Doherty et al. | |
| 2012/0084896 | A1 | 4/2012 | Wyner et al. | |
| 2014/0215694 | A1* | 8/2014 | Grice | A42B 3/06 2/411 |
| 2015/0272256 | A1 | 10/2015 | Meier | |

OTHER PUBLICATIONS

Sanchez, Manuel, "Using Specialty Engineered Foams in Seating Design," Aearo Company, 8 pages, Oct. 2000.
SFIA, "McDavid U.S.A. Hits a Home Run in Major League Baseball," 1 page, May 25, 2011.
4Licensing Corporation, "isoBLOX," http://web.archive.org/web/20131215193551/http://www.4licensingcorp.com/soblox/, 2 pages, 2013.
IsoBlox, Inc., "How isoBLOX Works," http://isoblox.com/how-isoblox-works/, 4 pages, 2014.
Weinbaum, William, "Pitchers to Debut New Protective Headgear in Spring Training," ESPN.com, 6 pages, Feb. 12, 2016.

* cited by examiner

PROTECTIVE HEADGEAR

CROSS-REFERENCE TO RELATED APPLICATION

The present application claims priority to and benefit from U.S. Provisional Patent Application No. 61/941,327 filed on Feb. 18, 2014, and titled "Protective Headgear," the entire content of which is herein expressly incorporated by reference.

TECHNICAL FIELD

The present invention is in the technical field of protective gear. More particularly, the present invention is in the technical field of head protection.

BACKGROUND

Conventional head protection devices are in the form of a helmet—non-conforming, rigid head pieces lined with a Styrofoam or foam layer to protect the head from skull fractures upon direct physical contact or impact with the ground or other surface. Baseball and softball batters and runners also wear helmets to protect their heads against forces of a speeding baseball or softball, which can reach speeds up to, for example, as much as 90-100 mph for a pitched ball and 120 mph for the exit speed of a home run ball.

Just like the batters, pitchers are at significant risk for concussion-type injuries because of their proximity to the plate. Depending on the level of competition, pitchers may be within 35 feet (softball) and 60 feet (baseball) of the plate after releasing the ball. The average and fastest exit speeds of a baseball off a swung bat has been measured among the top MLB players at approximately 105 mph and 120 mph, respectively, and can hit a pitcher before the pitcher has time to react. Such an impact can impart a shockwave into the brain that causes it to rebound or if a helmet is worn, it can impart a rebound effect between the head and the helmet.

SUMMARY OF THE INVENTION

Preferred embodiments of a protective device provide for a protective cap for a head of an individual. One preferred embodiment includes a hard shell that conforms to the curvature of the head. The preferred cap includes a flexible, comfortable, and energy-distributing shell for conforming to the head of the individual so as to define a surface area of protection preferably covering the frontal, temporal, parietal, and occipital regions of the skull. The preferred shell is of a lightweight, rigid or semi-rigid material with a hardness that produces load-distributing characteristics. The shell is preferably formed from a plurality of rigid panels that include a group of panels that have a geometry that conform to the curvature of the head. The plurality of protective panels further preferably include a group of adjacent panels to define a flexible seam therebetween. The adjacent panels preferably define one of a hexagonal or a pentagonal geometry. Adjacent panels further preferably define gap therebetween to allow the rigid panels to flex between each other. Preferably formed in the gap is a flexible seam that allows the rigid panels to flex between each other. The flexible seam can be an air gap; or additionally or alternatively include a flexible material disposed within the gap. Adjacent sides of adjacent panels preferably having the same length extending parallel to one another over a portion of the surface area of protection.

Another preferred embodiment provides a flexible headpiece for comfort management that conforms to the head of the individual so as to define a surface area of protection over a plurality of skull regions in the head. The headpiece preferably has energy-absorbing and dissipating properties. Preferably disposed about or formed about the headpiece is a segmented protective shell made of a material that distributes the load. The shell preferably includes rigid panels made of material that distributes the load. Gaps formed between the rigid panels allow the panels to flex between each other. The gaps can be filled with a flexible material to form a seam that allows the load of one panel to be transferred to the adjacent panel(s).

Preferred embodiments of the flexible headpiece is suitable for protective applications and thus preferred embodiments of the headpiece have energy-absorbing and dissipating properties. The preferred embodiments function to distribute the load and absorb energy with a comfortable fit for the user. Another preferred embodiment includes a flexible headpiece for conforming to the head of the individual so as to define a surface area of protection over a plurality of skull regions in the head. A plurality of protective panels are preferably fastened to the flexible headpiece to protect the head. Alternatively, the plurality of panels may be free to move with respect to the headpiece with the headpiece and the plurality of panels held in place by an outer housing. The plurality of protective panels preferably include a group of adjacent panels to define a flexible seam therebetween. Preferred panels define one of a hexagonal or a pentagonal geometry, in which adjacent panels defining a flexible seam therebetween including adjacent sides of the same length extending parallel one another over a portion of the surface area of protection.

Another preferred embodiment of a protective cap for a head of an individual includes a flexible headpiece for conforming to the head of the individual so as to define a surface area of protection over a plurality of skull regions in the head. The preferred cap includes a plurality of protective panels fastened to the flexible headpiece. Each of the panels defining a center point and a central axis extending through the center point normal to the panel. Each panel is preferably defined by a plurality of interconnected sides, each side being linear in a plane orthogonal to the central axis and tangent to the center point so as to define a polygon in the plane. The plurality of panels are adjacent to one another so as to cover the surface area of protection, the plurality of protective panels include a group of adjacent panels spaced apart so as to define a seam therebetween having sides of adjacent panels being of equal length and parallel to one another with a flexible joint formed in each seam. Preferred embodiments of the protective cap includes a headpiece and shell, which defines a preferred profile thickness that is suited for protective application and minimal distraction or discomfort.

BRIEF DESCRIPTION OF THE DRAWINGS

Embodiments of the present invention will be described and explained through the use of the accompanying drawings.

Figure 1:
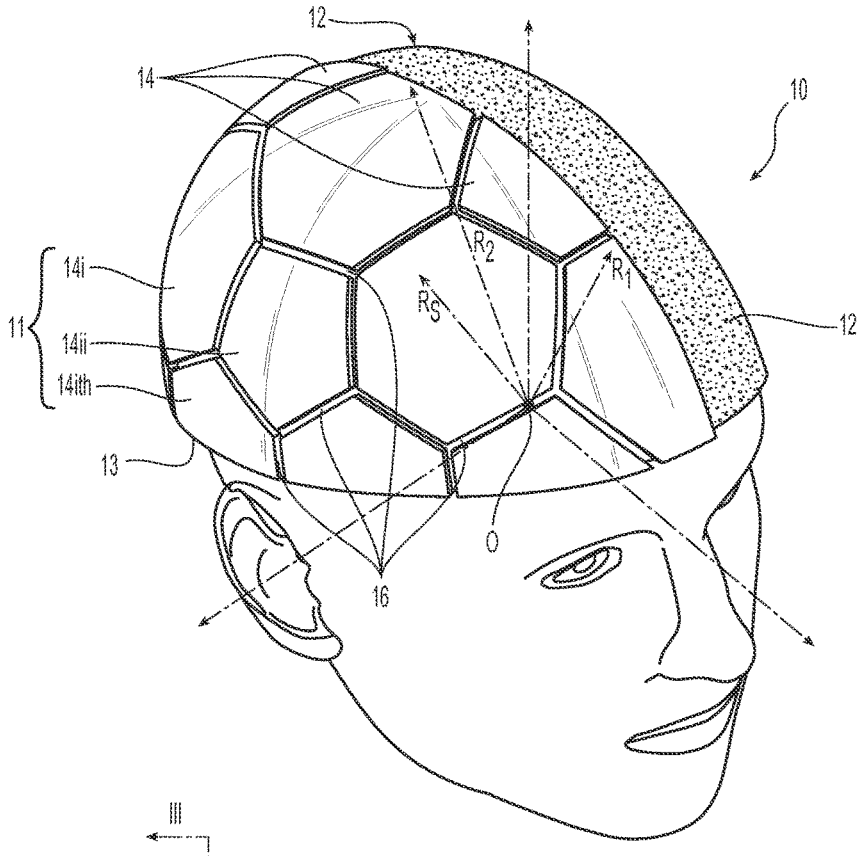
FIG. 1 is a partial isometric view of one preferred embodiment of a protective device.

The drawings have not necessarily been drawn to scale. For example, the dimensions of some of the elements in the figures may be expanded or reduced to help improve the understanding of the embodiments of the present invention. Similarly, some components and/or operations may be separated into different blocks or combined into a single block for the purposes of discussion of some of the embodiments of the present invention. Moreover, while the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 2:
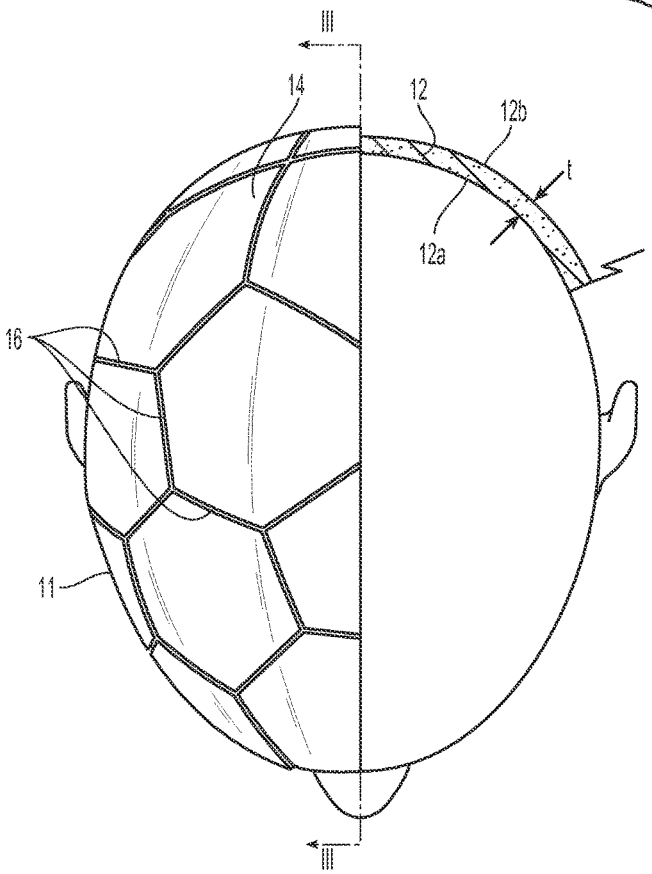
FIG. 2 is a partial plan and cross-sectional view of the protective device of FIG. 1.
Figure 3:
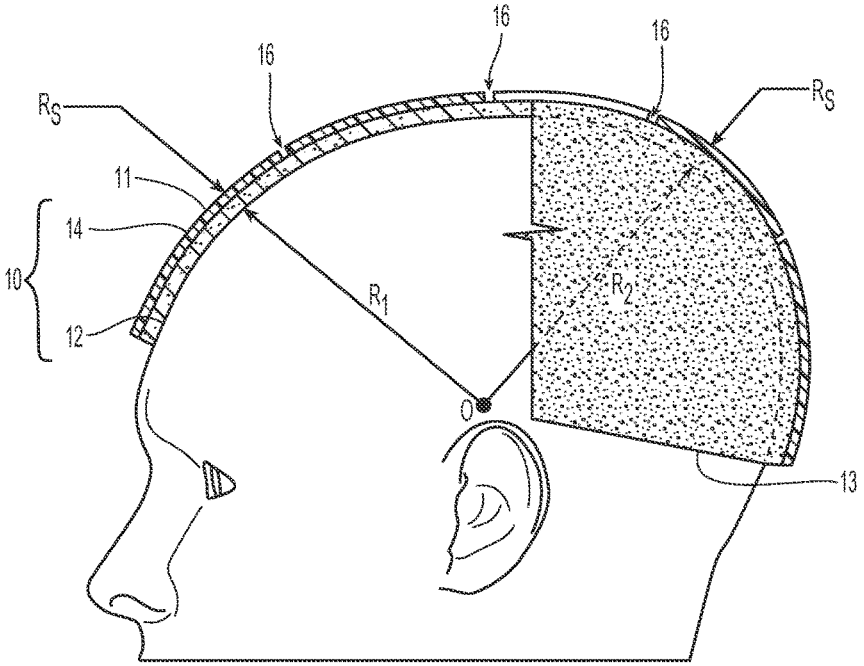
FIG. 3 is a cross-sectional side view of the device of FIG. 1 along line III-III in FIG. 2.

Shown in FIGS. 1-3 are views of one preferred embodiment of a protective device 10 for a head of an individual person. The device 10 preferably defines a surface area of protection which covers the frontal temporal regions of the head or skull of the individual and more preferably protects the frontal, temporal, occipital and parietal regions of the skull. Accordingly, the device is preferably configured as a cap 10 to protect the front, top, sides and back of the head from impact injuries and rebound effects of high speed objects as seen for example, in sports such as baseball as previously described. The cap 10 can be configured as a skull cap, for example, as shown; or alternatively can be configured as a baseball-style cap with a visor; or further in the alternative, the cap can be configured with any other type of brim to provide a desired hat configuration. Preferred embodiments of the device 10 provide head protection against a high-speed moving object, such as for example a baseball or softball moving at a speed of up to about 125 mph, for example. It should be understood that the device 10 can be alternatively configured to protect more or fewer regions of the skull.

The preferred protective device 10 forms a cap having a flexible, comfortable, and energy-absorbing underlying headpiece 12 with a preferably segmented outer shell 11 for conforming to the head of the individual. The headpiece 12 is preferably made from a deformable material that allows for flexibility to conform to various head sizes and/or shapes. Moreover, the headpiece 12 preferably functions to absorb and dissipate shock and impact energy to reduce the transfer and/or the focus of the energy to the wearer of the protective cap 10. The headpiece 12 is preferably made from an energy-absorbing material suitable for providing head and/or body protection in contact sports such as football or ice hockey or other sports such as for example, cycling, skiing or snowboarding. The energy-absorbing material is preferably suitable for comfort management and protection applications to provide protection from high-speed impact objects. An exemplary preferred material(s) for forming the headpiece 12 are the CONFOR® foams from E-A-R Specialty Composites in Indianapolis, Ind. and an Aero Company. As described on the E-A-R Specialty Composites website, the CONFOR® foams are urethane foams that "soften and conform when exposed to warmth, giving gentle, virtually pressure-free support. When the foams take a direct blow, however, their high energy-absorption characteristics enable them to absorb up to 97 percent of an impact. While they are slow to recover after deflection, they effectively resist compression set." The description can be found at <http://www.earsc.com/HOME/products/CushioningMaterials/CONFORFoams/index.as p?SID=265>. The shock-absorption, energy dissipating, rate responsiveness and dampening properties of the preferred CONFOR® foams is described in E-A-R Specialty Composites publication entitled, "Using Specialty Engineered Foams in Seating Design" (October 2000). The description therein of the CONFOR® foams properties and characteristics is incorporated by reference in its entirety. The publication is available at <http://www.earsc.com/HOME/engineering/TechnicalWhitePapers/HumanFactors/index. asp?SID=58>. However, it is to be understood that other energy absorbing or dissipating protective materials could be used.

The headpiece defines a surface area of protection preferably over the frontal, temporal, parietal, and occipital regions of the skull to preferably absorb and dissipate impact energy. Accordingly, in one preferred embodiment the device 10 the headpiece 12 defines a preformed shaped crown for covering an upper skull region of the head to provide the preferred energy-absorption protection and comfort. The preferably preformed shape is flexible enough to conform and/or deform to a user's head and sufficiently elastic to return to return to its initial shape. The headpiece 12 has an inner convex surface 12*a* defining the crown profile, an outer surface 12*b* preferably substantially parallel to the inner surface 12*a*. The headpiece 12 further defines a base 13 circumscribed about the crown profile.

As is generally understood in the art, a crown profile can define the depth or inner volume of a cap or hat and the manner the cap sits about the head. The higher the profile the more space is provided between the wearer's head and the inner surface of the cap. The lower the crown profile, the more the hat conforms to the head to minimize the gaps between the head and the inner surface of the cap. For the headpiece 12 and its preferably preformed shape, the crown profile can be any one of a high crown profile, a mid-crown profile or a low crown profile and more preferably defines a low crown profile. Because the headpiece 12 preferably conforms to the head of the wearer, any gap between the surface of the head of the individual and the device 10 is minimized and more preferably eliminated. Referring to FIGS. 1 and 3, the cap 10 and its headpiece 12 defines various regions of protection, each of which preferably define a different portion of the crown profile and the overall geometry of the preform shape. For example, a frontal region of the headpiece 12 protecting the frontal region of the skull can define a first portion of the crown profile having a first spherical radius of curvature R1 from a center of curvature O. A back region of the headpiece protecting the parietal and occipital regions of the skull defines a second portion of the crown profile having a second spherical radius of curvature R2 from the center O that is preferably different and more preferably greater than the first spherical radius of curvature R1. In one embodiment, the preformed shaped crown can define a half-egg or semi-ovoid shape. Alternatively, the crown profile can be substantially uniform over the entire headpiece such that the preformed shaped crown is substantially hemispherical. Further in the alternative, the inner surface 12*a* of the headpiece 12 can include inner surface treatments such as, for example, one or more grooves 12*aa* and/or ridges 12*ab*, as seen for example in FIG. 5C. In one preferred aspect the grooves 12*aa* and/or ridges 12*ab* can be configured or positioned to enhance the desired energy absorbing and dissipating characteristics of the headpiece 12. Additionally or alternatively, the grooves 12*aa* and/or ridges 12*ab* can be configured to provide a cooling effect to enhance comfort for the wearer.

The base 13 of the headpiece 12 preferably defines a maximum circumference of the cap 10. In a preferred manner of wearing the cap 10, the base 13 is located about the wearer's head just above the brow. In one preferred aspect, the base 13 can be dimensioned to correspond to any one of a standard hat size under a known hat measuring system, e.g., U.S. System or U.K. system. Summarized in Table 1 below are examples of standard adult head sizes.

TABLE 1

| | | | | | | | | | | | | |
|---|---|---|---|---|---|---|---|---|---|---|---|---|
| US System | 6⅝ | 6¾ | 6⅞ | 7 | 7⅛ | 7¼ | 7⅜ | 7½ | 7⅝ | 7 ¾ | 7⅞ | 8 |
| UK System | 6½ | 6⅝ | 6¾ | 6⅞ | 7 | 7⅛ | 7¼ | 7⅜ | 7½ | 7⅝ | 7¾ | 7⅞ |
| CM | 53 | 54 | 55 | 56 | 57 | 58 | 59 | 60 | 61 | 62 | 63 | 64 |
| Inches | 20¾ | 21¼ | 21⅝ | 22 | 22½ | 22¾ | 23¼ | 23⅝ | 24 | 24½ | 24¾ | 25¼ |

Again, the headpiece 12 is preferably made from a deformable material that allows for flexibility to conform to various head sizes and/or shapes. More preferably, the headpiece 12 is preferably flexible, expandable and elastic such that the base 13 and the crown profile can accommodate or conform to multiple standard hat sizes for adults or youth sizes. Alternatively, the headpiece 12 can be formed to any desired size to provide for a customized fit.

Figure 6:
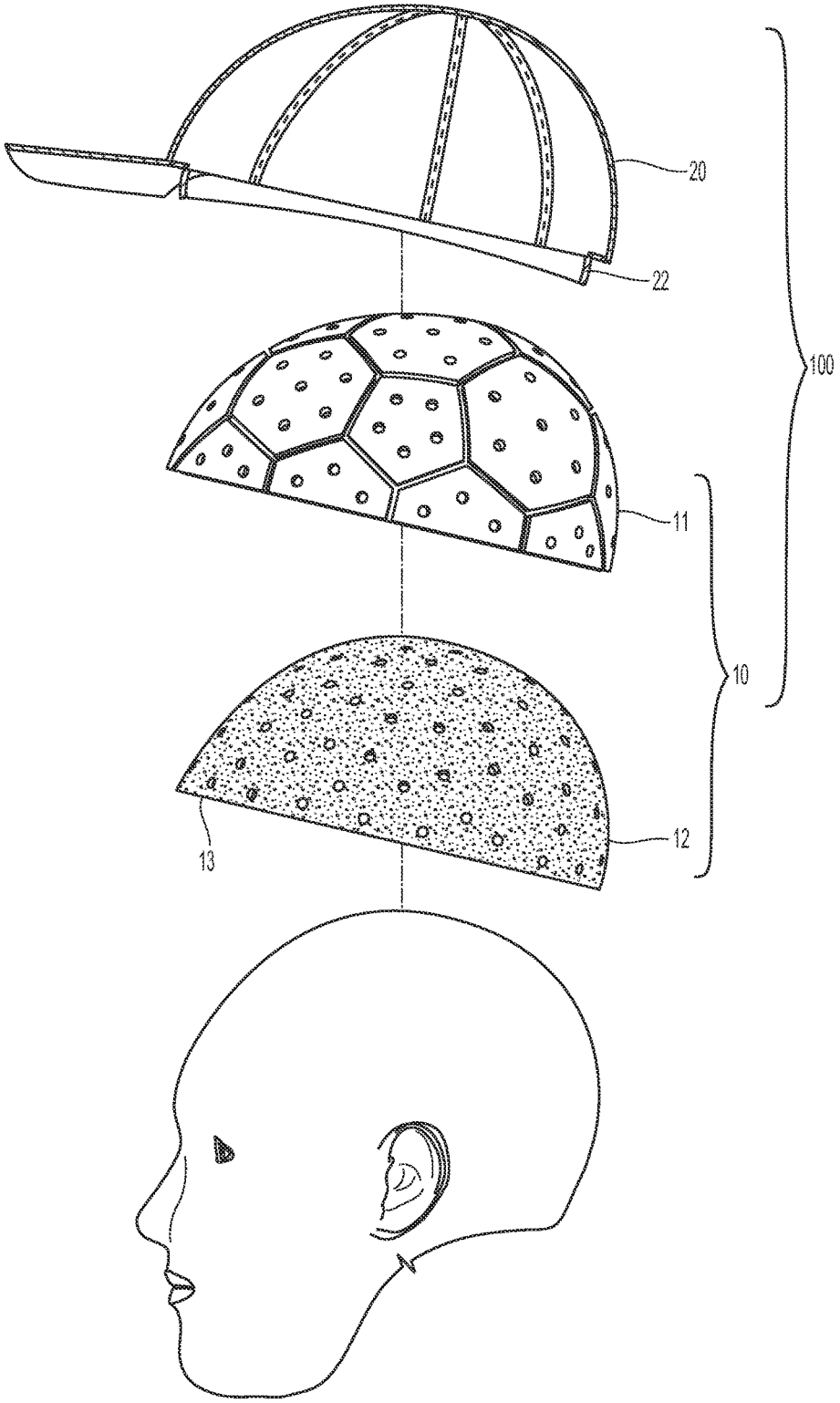
FIG. 6 is an exploded view of another preferred embodiment of the protective device.

To give the device flexibility and provide comfort when wearing, the headpiece material is preferably thin yet thick enough to provide the desired energy absorbing function in the preferred protection device 10. Referring to FIG. 2, the headpiece 12 has a preferred thickness t ranging from ¼ inch to about ⅜ inch. However, thinner or thicker materials can be used provided the headpiece provides the desired protection and flexibility described herein. To further facilitate the flexibility of the headpiece 12 and conformance to the variability in human head size and shape, the headpiece 12 can include one or more voids, openings or holes, as seen for example in FIG. 6, to provide expansion to facilitate the fit. The openings can additionally or alternatively provide cooling, ventilation and/or enhance breathability. A preferred headpiece 12 can be formed or modeled from a mannequin head or other structure to form or construct the preferred energy-absorbing material into the desired crown-profile and/or base 13 configuration and dimension. A preferred mold used to form the headpiece 12 can be dimensioned to define the standard or customized hat sizes previously described. Once formed, the headpiece 12 can be perforated, cut or punctured to provide any desired holes or openings.

Fastened to the headpiece 12 are a plurality of protective panels 14 (14*i*, 14*ii*, . . . 14*ith*) which collectively form the energy distributing preferably segmented outer shell 11. There are a number of different ways that the headpiece 12 and the panels 14 can interface. For example, the load distributing panels 14 can be mechanically attached to the headpiece 12 by a fastener or alternatively, the headpiece 12 can include a group of pockets (not shown) in which each panel 14 is housed in a pocket. Alternatively, the panels 14 can be chemically fastened to the headpiece 12 for example by an appropriate adhesive. Further in the alternative, the panels 14 can be layered together on the inside surface of an outer jacket, housing or outer cap which together is placed over and/or coupled to the headpiece 12.

The protective hard outer shell 11 defined by the panels 14 protects the head by spreading out and distributing the load of a high-speed impact object to the head. The protective panels 14 are preferably made of lightweight, rigid or semi-rigid material. Moreover in preferred embodiments, each panel defines a durometer scale hardness and/or an impact resistance that is typical of head protective gear such as helmets including for example batting or football helmets.

The panels are preferably aligned and spaced over the headpiece 12 and the defined surface area of protection to form a flexible joint or seam 16 therebetween which interconnects or spatially relates the panels 14 to form the load-distributing shell 11. Additionally, the segmentation and or space between panels 14 are preferably configured to allow for flexibility between the panels which can provide or enhance the overall flexibility and comfort of the protective cap 10. Accordingly, the plurality of protective panels 14 preferably include a group of adjacent panels 14 which define the seam(s) 16 therebetween. The seams 16 provide the device 10 with the flexibility by permitting the panels 14 to move with respect to one another in conformance to the wearers head. To maximize the protection of the device 10 while facilitating flexibility, the seams or spacing between the adjacent panels is preferably minimized. In preferred embodiments, the spacing between adjacent panels define a seam width w, as shown for example in FIG. 5B, which has a width that allows flexibility between the panels and allows load from one panel to be transferred to adjacent panels. In one preferred embodiment, seam width w ranges from 1 mm-3 mm. Moreover, the width w of the seams 16 preferably vary with the expansion or flex of the protective device 10. In a preferred embodiment, the gap or seam width w can displace or expand up to 3 mm and more preferably can expand up to 1 mm. The expansion of the seam 16 can be further limited to expand to an amount less than 1 mm, such as for example, from 0.5 mm. to 1 mm. and more preferably any one of 0.9 mm, 0.7 mm or 0.6 mm.

Figure 5A:
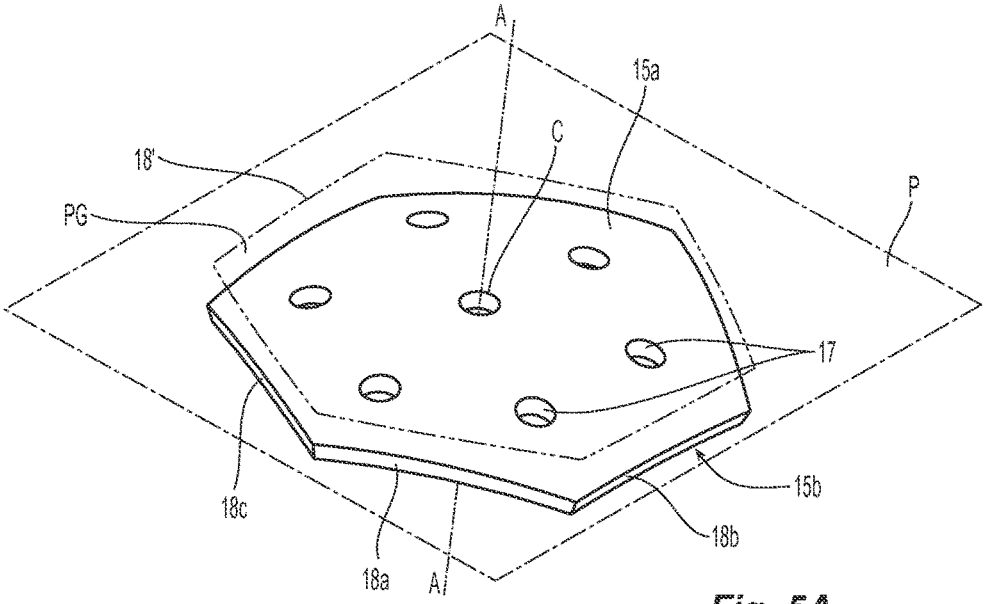
FIG. 5A is a isometric view of a preferred protective panel for use in the device of FIG. 1.
Figure 5B:
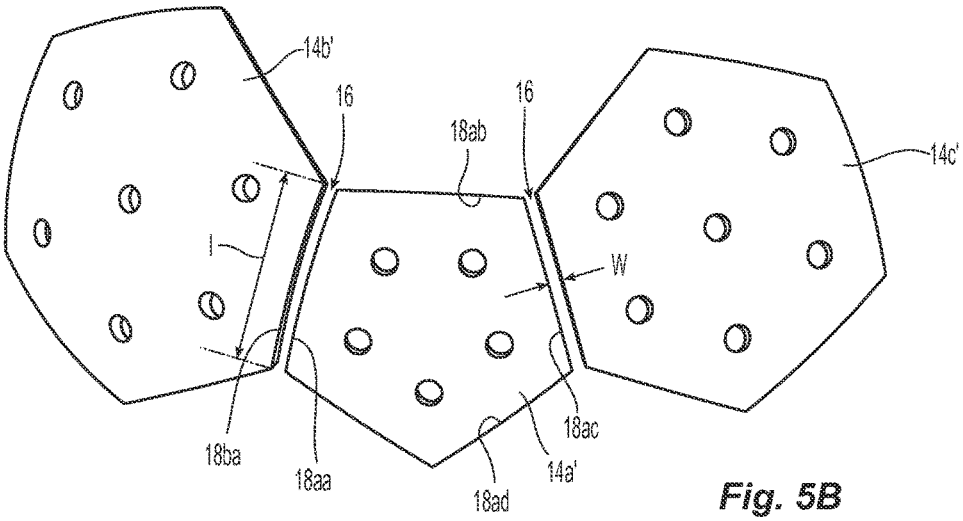
FIG. 5B is a plan view of a group of protective panels of one preferred embodiment of the device of FIG. 1.
Figure 5C:
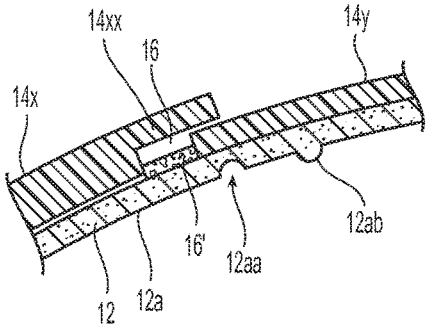
FIG. 5C is a detailed cross-sectional view of a preferred bridge element with alternate embodiments of a headpiece and seam for use in the protective device of FIG. 1.

The seams 16 can provide for an air gap between the panels or alternatively, the seams 16 can include disposed therein a flexible, load bearing and/or distributing energy absorbing material 16', such as for example polyurethane or silicone, to interconnect the panels 14, as seen for example in FIG. 5C. The seams 16 preferably distribute impact loads to adjacent panels and more preferably distribute impact loads over all the panels. Accordingly, in a preferred embodiment of the device 10, the seams 16 formed by the spaced apart panels 14 are preferably interconnected with one another. Additionally or alternatively, the device 10 can include a bridge element or segment that crosses over the seam 16. The protective cap of claim 33, wherein the plurality of panels are spaced apart to define a seam, the cap further comprising a bridge segment connecting two panels and extending over the seam. For example, shown in the cross-sectional view of FIG. 5C are two adjacent panels 14*x*, 14*y* with the seam 16 in between. One panel 14*x* can include a cantilevered element or segment 14'*xx* that bridges the seam 16 and overlaps the adjacent edge of adjacent panel 14*y*. The bridge element 16 can extend lengthwise over the axial length of the seam 16 or be shorter than the seam length. The bridge element 14'*xx* can provide for additional protection and/or facilitate sliding engagement between adjacent panels 14. Moreover, preferred embodiments of the panel geometry and flexibility described herein provide the protective device 10 and its shell 11 with an outer surface that is preferably without sharp curves, edges, sharp points or breaks.

In the preferred embodiment of the protective device 10 shown in FIGS. 1-3, the adjacent panels 14 have sides that preferably define one of a hexagonal or a pentagonal geometry. Adjacent panels 14 are preferably dimensioned, spaced and aligned with one another so that sides of the adjacent panels having the same length are adjacent to one another to define the interconnected seams 16 previously described. Moreover, in the particular embodiment of the device 10, the panels 14 are preferably aligned and interconnected with one another such that the protective device or cap 10 will define a truncated icosohedron so as to more generally mimic a surface of a soccer ball.

Shown in FIGS. 4A-4D are various views of a preferred embodiment of the protective cap 10 having a preferred pattern of whole and partial hexagonal and pentagonal panels 14. The preferred pattern arranges the panels 14 and seams 16 in a manner to facilitate the desired flexibility and protection as described herein. The cap 10 defines a frontal region 10*a*, a back region 10*b* and a vertical plane P extending from the back region 10*b* to the frontal region 10*a*. The cap 10 and the pattern of its panels 14 are preferably symmetrical about the vertical plane P. Referring to the front and back views of FIGS. 4B and 4C, the preferred pattern includes a first preferred group of panels having a first whole hexagonal panel 14*a* centered in the frontal region 10*a* so as to be bisected by the vertical plane P and a second whole hexagonal panel 14*b* centered in the back region 10*b* so as to be bisected by the vertical plane P. Now referring to the plan view of the top of the protective cap 10 in FIG. 4A, the first preferred group of panels 14 includes a third whole hexagonal panel 14*c* and a fourth whole hexagonal panel 14*d* adjacent to the third hexagonal panel to define a central seam 16*a* preferably axially aligned along the vertical plane P. The third and fourth hexagonal panels 14*c*, 14*d* are preferably located between the first and second hexagonal panels 14*a*, 14*b*. A first whole pentagonal panel 14*e* is preferably disposed between the first, third, and fourth whole hexagonal panels 14*a*, 14*c*, 14*d* and bisected by the plane P. A second whole pentagonal panel 14*f* is preferably disposed between the second, third and fourth whole hexagonal panels 14*b*, 14*c*, 14*d* and bisected by the plane P.

Figure 4A:
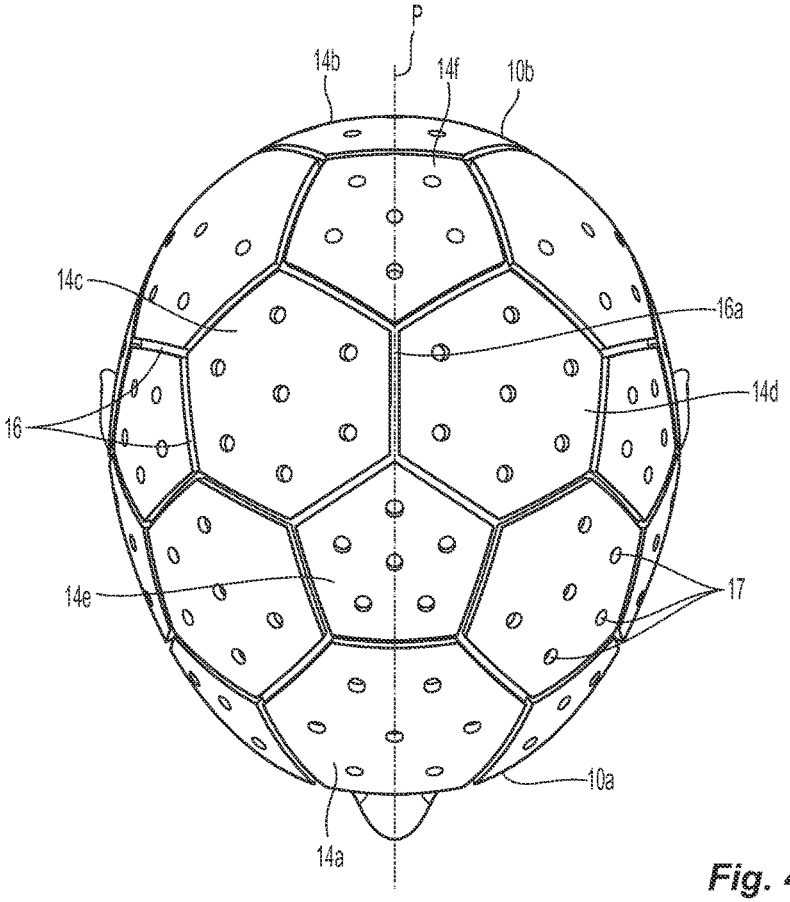
FIGS. 4A-4D are plan, from, back and side views of another preferred embodiment of the protective device.
Figure 4B:
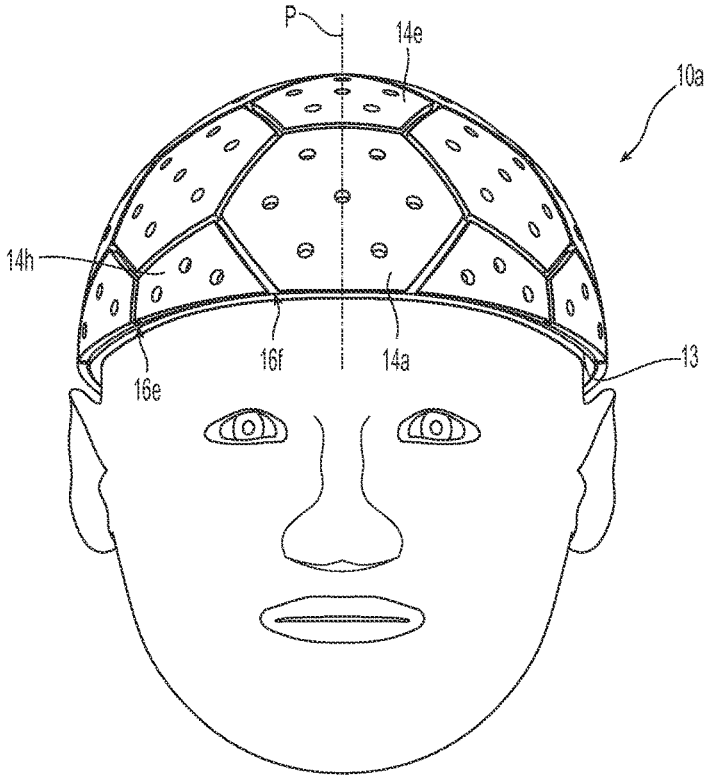
Figure 4C:
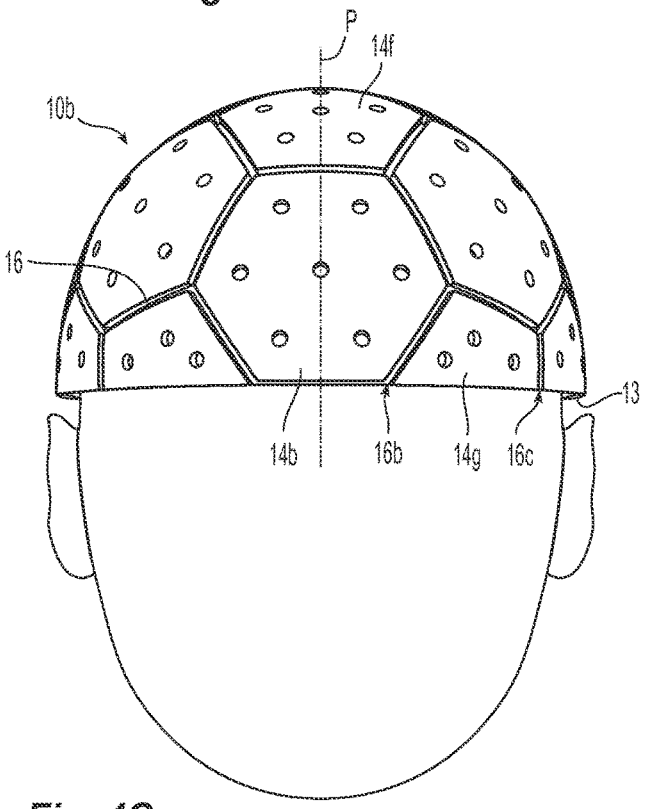
Figure 4D:
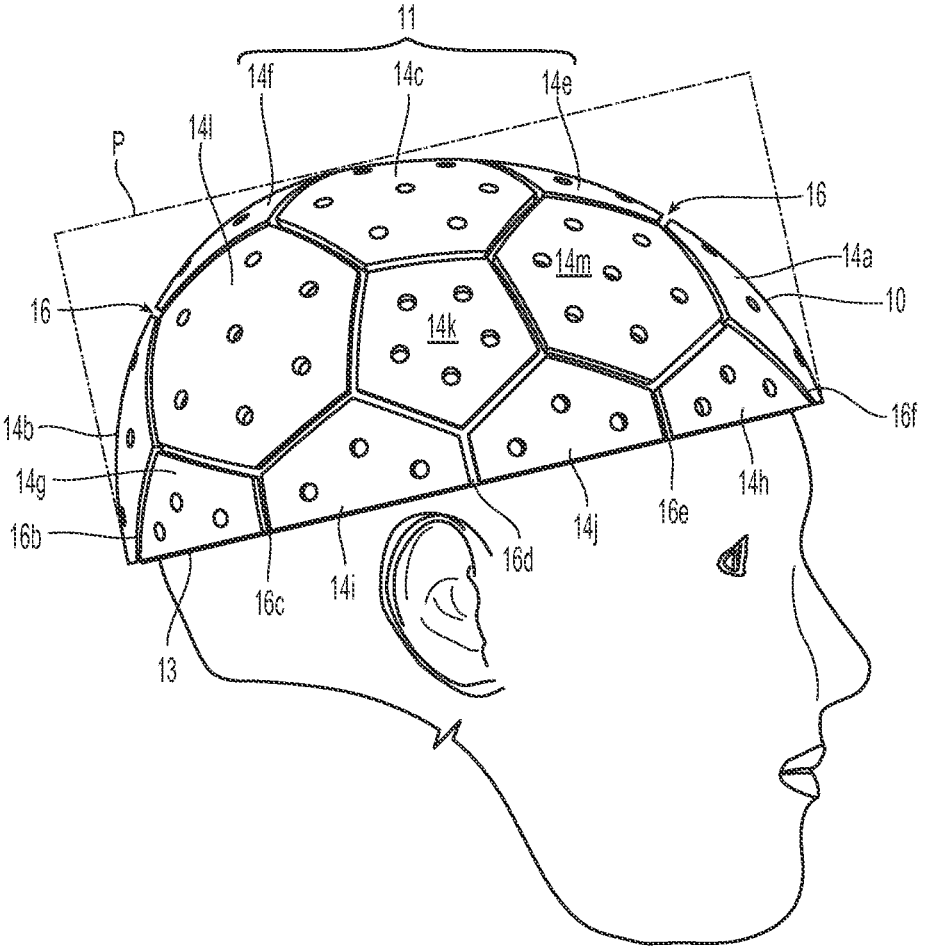

Referring to the side view of the protective cap 10 shown in FIG. 4D, the preferred pattern includes a second group of panels 14 laterally of the plane P that includes partial panels, and more preferably, includes half-hexagonal and half-pentagonal panels that are disposed along the base 13 with their edges aligned along the base 13. More specifically, the preferred second group of panels includes a first half-pentagonal panel 14*g* adjacent the second whole hexagonal panel 14*b* and a second half-pentagonal panel 14*h* adjacent the first whole hexagonal panel 14*a*. The preferred first and second whole hexagonal panels preferably have their edges aligned along the base 13. Preferably disposed between the first and second half-pentagonal panels 14*g*, 14*h* are a first half-hexagonal panel 14*i* and a second half-hexagonal panel 14*j* adjacent the first-half hexagonal panel 14*i*. On each side of the plane P preferably formed between each of the adjacent and spaced apart panels along the base 13 are five gaps or seams 16*b*, 16*c*, 16*d*, 16*e*, 16*f* to preferably provide a total of ten (10) expandable seams 16 spaced along the base 13 of the cap 10. As previously noted the circumference of the cap 10 defined by the base 13 can define one and preferably more than one hat size. In one preferred aspect, the expandability of the ten gaps or seams 16*b*, 16*c*, 16*d*, 16*e*, 16*f* formed along the base 13 between the panels 14 can define the expandability of the base and the cap 10 overall and the ability to cover multiple hat sizes. For example, under the U.S. Department of Defense Military Handbook DOD-HDBK-743A: "Anthropometry of U.S. Military Personnel (Metric)" (Feb. 13, 1991) at Table 86b, percentiles values for head circumference is provided. In the first row of Table 2 below are the percentile values for the head circumferences in cm of "US Army Men (1988)" taken from Table 86b and shown in the second row of the table. The "Head Circumference" is the maximum horizontal circumference of the head, measured with the tape passing above the brow-ridges and the ears.

TABLE 2

| Percentile | 1st | 2nd | 5th | 10th | 25th | 50th | 75th | 90th | 95th | 98th | 99th |
|---|---|---|---|---|---|---|---|---|---|---|---|
| Head Circumference (cm) | 53.3 | 53.7 | 54.3 | 54.8 | 55.7 | 56.8 | 57.8 | 58.7 | 59.4 | 60.1 | 60.7 |
| Difference over percentiles (cm) | | 1 | | | 0.9 | | 1 | | 0.7 | | 0.6 |
| Gap per segment over 10 segments (mm) | | 1 | | | 0.9 | | 1 | | 0.7 | | 0.6 |

In row three, below the head circumference values, are the "Difference over percentile (cm)," which shows five difference values for each of five grouped percentiles. For example, the third difference value between the fiftieth (50th) and seventy-fifth (75th) percentile is 1 cm., which corresponds to the difference between head circumference values (56.8 and 57.8 respectively) of the two percentile values. In the last row of the Table 2, a "gap per segment" in millimeters identifies for each of the ten gaps or seams 16*b*, 16*c*, 16*d*, 16*e*, 16*f* an amount of displacement or expansion for the cap 10 to cover or fit multiple percentiles or head circumferences. Under Table 2, five configurations of hat size and seam expansion are identified for covering the 1st through the 99th percentile values of the given head circumference. Thus for example, a preferred cap 10 with a base fitting a head circumference of 53.3 cm. with each of the preferred ten seams 16*b*, 16*c*, 16*d*, 16*e*, 16*f* expanding up to 1 mm can fit or cover each of the 1st, 2nd and 5th percentiles.

Referring again to FIG. 4D, the preferred pattern of panels 14 of the cap 10 include a third group of panels located laterally of the plane P between the first and second group of panels previously described. The third group of panels preferably include a third whole pentagonal panel 14*k* between one of the third and fourth whole hexagonal panels 14*c*, 14*d* and the first and second half-hexagonal panels 14*i*, 14*j*. The preferred third group of panels of the preferred panel pattern includes a fifth whole hexagonal panel 14*l* and a sixth whole hexagonal panel 14*m* disposed about the third whole panel 14*k* and between the first and second groups of panels previously described. For the preferred embodiment of the cap 10 shown in FIGS. 4A-4D, the cap 10 can be assembled with a total of twenty (20) panels.

Shown in FIG. 5A is an exemplary embodiment of a protective panel 14. The panel preferably defines a center point C and a central axis A-A extending through the center point C normal to the panel 14. Each panel 14 is preferably defined by a plurality of interconnected edges or sides 18 (18*a*, 18*b*, 18*c*, . . . 18*nth* sides). Each side 18 preferably defines a linear projection 18' in a plane P orthogonal to the central axis A-A and more preferably tangent to the center point C so as to define a polygon PG in the plane, such as for example the hexagon shown in FIG. 5A or alternatively a pentagon. The panels 14 can include one or more voids, holes or openings 17, as shown in FIG. 5A or the preferred cap of FIGS. 4A-4D, to provide facilitate or enhance cooling and or breathability.

As formed about the protective device 10, each of the plurality of panels 14 preferably has an outer convex surface 15*a* and an opposite inner preferably concave surface 15*b* defining the thickness of the panel 14 in between. Preferably, the panels 14 have a thickness from 1/10 in. to 1/8 in. The thickness can be constant over the panel or alternatively variable. The outer convex surface of the protective panels 14 preferably prevents or eliminates flat surfaces in the device 10 that can cause sharp edges or corners. In preferred embodiments of the panel 14, the outer convex surface 15*a* can define a panel width that spans across the surface 15*a* and passing through the center C to define a panel width that preferably facilitates load distribution and conformance to the head. The inner concave surface 15*b* defines one or more radii of curvature to substantially conform the protective panels 14 to the head of an individual. Referring to FIGS. 3 and 1, the panels 14 collectively preferably define a preferably variable spherical radius of curvature RS so that the device 10 conforms to a range of head profiles. More specifically, the collective interconnection of panels 14 define an internal profile of the shell 11 with a spherical radius of curvature R that varies in a manner to conform to the head of an end-user of the device 10. More preferably, each panel 14 conforms to the portion of the headpiece to which it adheres. Accordingly, the inner surface 15*b* of each panel extends or spans preferably parallel over the outers surface of the headpiece 12. In a preferred embodiment, the headpiece defines at least one spherical radius of curvature R1, R2 from a common center point O, and each panel 14 of the outer segmented shell 11 defines at least one spherical radius of curvature RS from the common center point O. The spherical radius RS of the shell at the particular panel 14 outside of the headpiece 12 defining the spherical radius R1, R2 is greater than the spherical radius of curvature of the headpiece 12 by a preferred amount ranging between 1/4 to about 3/8 inch. In one preferred embodiment in the formation of the panels 14, the profile of mold or head used to form the headpiece 12 can be modeled in a computer and characterized by a sufficient number of spherical radii of curvatures. From the computer model, a corresponding shell can be determined by incorporating an offset, such as for example and increase in the spherical radii by a common factor, such as for example, 1/4 inch to 0.35 inch. The modeled shell can be segmented into the desired panel geometries. Each panel 14 can be printed out for example, on a 3D computer from the computer model and appropriately mapped onto and fastened to the headpiece 12 to provide the assembled protective device 10. The individual panels 14 can be fabricated by alternate technique provided the panels provide for the protection, flexibility and comfort in wear as described.

Preferably, as shown in FIG. 5B, adjacent protective panels provide for adjacent parallel sides of 18*aa*, 18*ba* of equal length l to define the seams 16 of the shell 11. More preferably in plan, preferred embodiments of the device 10 provide for a group of adjacent panels which define a plurality of equilateral polygons in plan such as for example as the hexagons and pentagons as shown. In the alternative, the protective panel 14 can define other polygons in plan. Accordingly, the panel 14 can be formed with any number of sides, for example, ten or fewer sides, eight or fewer sides, or six or fewer sides. Shown are adjacent panels 14 *a*', 14*b*', 14*c*' of varying geometry. Further in the alternative, the group of adjacent protective panels can be defined by panels of similar geometry. Even further in the alternative, groups of panels can be integrally formed as an integral or singular panel defining its own larger geometry. For example, referring to the first, second, and third groups of panels previously described with respect to FIGS. 4A-4D, any one of the groups of panels 14 can be formed integrally. By forming larger sized panels 14, the number of seams 16 may be reduced, provided the resulting geometries and device 10 can still adequately and comfortably protect the wearer's head in a manner as described herein.

As previously noted, the protective device 10 preferably wears like a cap on an individual. The cap 10 can be configured as a baseball-style cap with a visor or brim. A preferred embodiment of the cap 100 is shown in an exploded view in FIG. 6. Shown is the headpiece 12, the outer preferably segmented shell 11 and an outer cap or housing 20, shown as a baseball cap. The outer cap 20 can be a standard size baseball cap preferably large enough to house the device 10. Accordingly, where the headpiece 12 and device 10 define a standard hat size, the outer cap 20 is preferably 1/2 to one standard size larger. Alternatively or additionally, the outer cap 20 can include a lip or seal 22 that can be folded over the base 13 of the headpiece 12 to secure the protective device 10 within the housing 20. Further in the alternative, the outer cap 20 can include or the lip or seal 22 can form and internal shelf along the edge of the outer cap 20 to hold the protective device 10 in place. Moreover in another alternate aspect, with an outer cap 20 to hold the headpiece 12 and shell 11 together, the headpiece 12 and shell 11 can be permitted to move independently with respect to one another so as not to require for any fixture between the headpiece 12 and shell 11.

The features described herein of the protective device 10 can be customized appropriately to provide the desired protection for a given application. For example, the number of panels 14, the geometry of the panels 14 and their location on the headpiece 12 can be varied to provide the desired protection over particularized regions of the skull or head. In one preferred aspect, the number and size of protective panels 14 are related to the size of the cap 10 for example as measured in hat size. In addition to the general shape or geometry of the panels 14, the thickness and rigidity of the panels can be varied individually to suit a particular application. Moreover as described, the headpiece 12 can define a customized profile, configuration and thickness that minimizes distractions and discomfort to the wearer.

The above Detailed Description of embodiments of the disclosure is not intended to be exhaustive or to limit the invention to the precise form disclosed above. While specific examples for the invention are described above for illustrative purposes, various equivalent modifications are possible within the scope of the invention, as those skilled in the relevant art will recognize. In conclusion, the present invention provides novel systems, methods and arrangements for protective headgear. While detailed descriptions of one or more embodiments of the invention have been given above, various alternatives, modifications, and equivalents will be apparent to those skilled in the art without varying from the spirit of the invention. For example, while the embodiments described above refer to particular features, the scope of this invention also includes embodiments having different combinations of features and embodiments that do not include all of the described features.

What is claimed is:

1. A protective cap for a head of an individual comprising:

a flexible headpiece shaped to conform to the head; and a plurality of protective panels fastened to the flexible headpiece and arranged adjacent to each other to define a plurality of flexible seams therebetween, the flexible seams including adjacent sides extending parallel to one another over a portion of the headpiece, wherein the headpiece defines at least one spherical radius of curvature from a common center point, and the plurality of panels forming an outer shell defines at least one spherical radius of curvature from the common center point, the at least one spherical radius of curvature of the shell being greater than the at least one spherical radius of curvature of the headpiece by an amount ranging between about ¼ to about ⅜ inch.

2. The protective cap of claim 1, wherein the plurality of panels include hexagonal shaped panels and pentagonal shaped panels to define a truncated icosahedron.

3. The protective cap of claim 1, wherein the plurality of seams are interconnected to one another.

4. The protective cap of claim 1, wherein the headpiece defines an inner concave surface with a variable radius of curvature that conforms to a range of crown profiles.

5. The protective cap of claim 4, wherein the inner concave surface conforms to any one of a high crown profile, a mid-crown profile and a low crown profile.

6. The protective cap of claim 4, wherein a frontal region of the headpiece defines a first portion of the crown profile having a first spherical radius of curvature, and a back region of the headpiece defines a second portion of the crown profile having a second spherical radius of curvature different than the first spherical radius of curvature.

7. The protective cap of claim 1, wherein each of the panels is rigid and curved and the flexible headpiece is formed from a rate responsive urethane foam.

8. The protective cap of claim 1, wherein the headpiece defines a preformed shaped crown, the preformed shaped crown is substantially hemispherical.

9. The protective cap of claim 1, wherein the headpiece defines a material thickness from an inner surface to an outer surface ranging from about ¼ inch to about ⅜ inch.

10. The protective cap of claim 1, wherein the plurality of protective panels define a segmented outer protective shell, the headpiece being made of a urethane foam, the urethane foam being a rate responsive urethane foam.

11. The protective cap of claim 1, wherein each of the plurality of panels has a thickness ranging from 1/10 inch to ⅛ inch.

12. The protective cap of claim 1, wherein the plurality of panels are spaced apart to define a seam width therebetween ranging between 1 mm-3 mm.

13. The protective cap of claim 1, wherein the plurality of panels are spaced apart to define an expandable seam width therebetween, the width expanding between 0.5 mm-3 mm.

14. The protective cap of claim 1, further comprising a bridge segment extending over the seam.

15. The protective cap of claim 1, wherein at least one of the headpiece and the plurality of panels includes a plurality of openings to provide for cooling.

16. The protective cap of claim 1, further comprising an outer cap for housing the headpiece and protective panels.

17. The protective cap of claim 16, wherein the outer cap is a baseball cap having a lip to support the headpiece and panels.

18. A protective cap for a head of an individual comprising:

a flexible headpiece shaped to conform to the head; and a plurality of protective panels fastened to the flexible headpiece and arranged adjacent to each other to define a plurality of flexible seams therebetween, the flexible seams including adjacent sides extending parallel to one another over a portion of the headpiece, the plurality of panels include hexagonal shaped panels and pentagonal shaped panels to define a truncated icosahedron, wherein the cap defines a frontal region, a back region and a vertical plane extending from the back region to the frontal region, the cap being symmetrical about the plane, the plurality of panels having a first group of panels including a first hexagonal panel in the frontal region, a second hexagonal panel in the back region, the first and second hexagonal panels being bisected by the plane, the plurality of panels including a third hexagonal panel and a fourth hexagonal panel adjacent to the third hexagonal panel to define a seam axially aligned along the plane, the third and fourth hexagonal panels being located between the first and second hexagonal panels, a first pentagonal panel being disposed between the first, third and fourth hexagonal panels and bisected by the plane; and a second pentagonal panel being disposed between the second, third and fourth hexagonal panels and bisected by the plane.

19. The protective cap of claim 18, wherein the flexible headpiece defines a base to circumscribe the head, the plurality of panels including a second group of panels laterally of the plane and disposed along the base, the second group of panels including a first half-pentagonal panel adjacent the second hexagonal panel and a second half-pentagonal panel adjacent the first hexagonal panel, a first half-hexagonal panel and an adjacent second half-hexagonal panel adjacent the first half-hexagonal panel, the first and second half-hexagonal panels being disposed between the first and second half-pentagonal panels.

20. The protective cap of claim 19, wherein the plurality of panels include a third group of panels laterally of the plane between the first and second group of panels, the third group of panels including a third whole pentagonal panel between one of the third and fourth whole hexagonal panels and the first and second semi-hexagonal panels, the third group of panels including a fifth whole hexagonal panel and a sixth hole hexagonal panel disposed about the third whole pentagonal panel.

21. A protective cap for a head of an individual comprising:

a flexible headpiece for conforming to the head of the individual so as to define a curved surface area of protection over a plurality of skull regions in the head;

a plurality of rigid and curved protective panels disposed about the flexible headpiece to protect the head, each of the panels defining a center point and a central axis extending through the center point normal to the panel, each panel being defined by a plurality of interconnected sides, each side being linear in a plane orthogonal to the central axis and tangent to the center point so as to define a polygon in the plane, the plurality of panels being adjacent to one another so as to cover the curved surface area of protection, the plurality of protective panels include a group of adjacent panels spaced apart so as to define a seam therebetween having sides of adjacent panels being of equal length and parallel to one another; and a flexible joint formed in each seam.

22. The protective cap of claim 21, wherein each panel defines a durometer scale hardness that produces load-distributing characteristics and the headpiece is formed from a rate responsive urethane foam.

23. The protective cap of claim 21, wherein the seam defines a seam width which allows flexibility between the panels.

24. The protective cap of claim 21, wherein the joint of the seam includes a gap between the panels that is filled with a flexible material that allows an impact load to be carried from one panel to another panel, the flexible material being any one of a polyurethane or silicone.

25. The protective cap of claim 21, wherein the adjacent panels define a plurality of seams, the plurality of seams being interconnected to one another, the panels being one of fastened to the headpiece by an adhesive or permitted to move with respect to the headpiece.

* * * * *